US008598483B2

(12) United States Patent
Dienemann et al.

(10) Patent No.: US 8,598,483 B2
(45) Date of Patent: Dec. 3, 2013

(54) HIGH-VOLTAGE POWER SWITCH HAVING A CONTACT GAP EQUIPPED WITH SWITCHING GAS DEFLECTION ELEMENTS

(75) Inventors: Hold Dienemann, Berlin (DE); Volker Lehmann, Treuenbrietzen (DE); Manfred Meinherz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 207 days.

(21) Appl. No.: 13/201,230

(22) PCT Filed: Jan. 22, 2010

(86) PCT No.: PCT/EP2010/050731

§ 371 (c)(1), (2), (4) Date: Aug. 12, 2011

(87) PCT Pub. No.: WO2010/091933

PCT Pub. Date: Aug. 19, 2010

(65) Prior Publication Data

US 2011/0297648 A1 Dec. 8, 2011

(30) Foreign Application Priority Data

Feb. 13, 2009 (DE) ..... 10 2009 009 451

(51) Int. Cl.
*H01H 33/08* (2006.01)

(52) U.S. Cl.
USPC ..... 218/53; 218/46; 218/59

(58) Field of Classification Search
USPC ..... 218/46, 51, 59–62, 53
See application file for complete search history.

(56) References Cited

U.S. PATENT DOCUMENTS

| | | | | | |
|---|---|---|---|---|---|
| 4,070,558 | A | * | 1/1978 | Stewart et al. | 218/62 |
| 4,229,627 | A | | 10/1980 | Rostron | |
| 4,236,053 | A | | 11/1980 | Sasaki et al. | |
| 4,445,019 | A | | 4/1984 | Gaupp et al. | |
| 4,577,074 | A | * | 3/1986 | Pham | 218/59 |
| 4,684,773 | A | * | 8/1987 | Niemeyer | 218/46 |
| 5,206,481 | A | * | 4/1993 | Rossner et al. | 219/121.48 |
| 5,483,210 | A | | 1/1996 | Otterberg et al. | |
| 5,578,806 | A | * | 11/1996 | Hofbauer et al. | 218/59 |
| 5,717,183 | A | * | 2/1998 | Lehmann et al. | 218/90 |
| 5,856,647 | A | * | 1/1999 | Luo | 219/121.5 |
| 6,040,970 | A | | 3/2000 | Lehmann et al. | |
| 2007/0075044 | A1 | | 4/2007 | Ye et al. | |
| 2008/0006608 | A1 | | 1/2008 | Saxl et al. | |
| 2008/0314873 | A1 | | 12/2008 | Dahlquist et al. | |

FOREIGN PATENT DOCUMENTS

| | | |
|---|---|---|
| DE | 27 50 763 A1 | 6/1978 |
| DE | 295 20 809 U1 | 2/1996 |
| DE | 195 47 522 C1 | 1/1997 |
| DE | 200 15 563 U1 | 1/2002 |

(Continued)

OTHER PUBLICATIONS

German Patent and Trademark Office Search Report, Dated May 27, 2009.

*Primary Examiner* — Truc Nguyen
(74) *Attorney, Agent, or Firm* — Laurence A. Greenberg; Werner H. Stemer; Ralph E. Locher

(57) ABSTRACT

A switching device assembly with a contact gap has a nozzle made of insulating material. The nozzle made of insulating material is formed with a nozzle channel that ends in a hot gas space. A deflector element is arranged within the hot gas space. The deflector element is supported inside the deflector channel.

16 Claims, 2 Drawing Sheets

(56) References Cited

FOREIGN PATENT DOCUMENTS

| | | | |
|---|---|---|---|
| EP | 0 081 253 | A1 | 6/1983 |
| EP | 1 372 172 | A1 | 12/2003 |
| FR | 2 760 890 | A1 | 9/1998 |
| GB | 1 545 998 | A | 5/1979 |
| JP | 5284465 | A | 7/1977 |
| JP | 61124938 | U | 8/1986 |
| JP | 0260013 | A | 2/1990 |
| JP | 2 086 023 | A | 3/1990 |
| JP | 4147528 | A | 5/1992 |
| JP | 2000509544 | A | 7/2000 |
| JP | 2007073384 | A | 3/2007 |
| JP | 2008502098 | A | 1/2008 |
| JP | 2008525945 | A | 7/2008 |
| JP | 2009528653 | A | 8/2009 |

* cited by examiner

HIGH-VOLTAGE POWER SWITCH HAVING A CONTACT GAP EQUIPPED WITH SWITCHING GAS DEFLECTION ELEMENTS

BACKGROUND OF THE INVENTION

1. Field of the Invention

The invention relates to a switching device arrangement having a contact gap, which is surrounded at least partially by an insulating nozzle, whose nozzle channel opens out in a heating gas volume, within which a deflector element is arranged.

Such a switching device arrangement is known, for example, from the Patent Abstract of Japan JP 02-086023. In said document, a contact gap is surrounded by an insulating nozzle. A nozzle channel of the insulating nozzle opens out in a heating gas volume. During a switching operation, expanded switching gas is guided via the nozzle channel into the heating gas volume. Furthermore, a deflector element is arranged within the heating gas volume, said deflector element causing the heating gas volume to be flushed with the switching gas in a certain way.

Valve openings are arranged within the heating gas volume on the end sides. Such valve openings, owing to movable elements, have a higher probability of failure than immovable assemblies.

2. Brief Summary of the Invention

The object of the invention is therefore to specify a switching device arrangement which ensures sufficient flushing of the heating gas volume with switching gases with a low probability of failure.

According to the invention, the object is achieved in a switching device arrangement of the type mentioned at the outset by virtue of the fact that the deflector element has a deflector channel and is supported within the deflector channel.

Supporting or holding the deflector element within the deflector channel provides the possibility of providing any desired formations or shapes for the deflector element on the lateral side and on the end sides. A versatile configuration of the deflector element is therefore possible, with the result that, by virtue of the combination of the deflector element and the shape of the heating gas volume, it is possible for more targeted mixing of switching gas and cold insulating gas stored in the heating gas volume to take place.

During a switching operation, it is possible for a switching arc to be struck in the contact gap. The switching arc expands the switching gas and heats it. The switching gas can be, for example, heated insulating gas such as sulfur hexafluoride or it is also possible for hard gas released from plastics to be used. This switching gas is also passed on from the hot switching arc via the nozzle channel and introduced into the heating gas volume and buffer-stored there. Once the switching arc has subsided or in order to cool and clear the contact gap of arc plasma, the gas which has been buffer-stored in the heating gas volume is ejected into the contact gap again.

Before hot switching gases are introduced, the heating gas volume is filled with cold insulating gas which has not been subjected to the switching arc. Owing to a suitable arrangement and shape of the deflector element, mixing of hot switching gas and cold insulating gas within the heating gas volume is either promoted or suppressed. Depending on the switching task to be achieved by the switching device arrangement, thorough mixing and blending of the cold and heating gases in the heating gas volume can be provided. However, provision can also be made for there to be preferably virtually swirl-free stratification of the gases within the heating gas volume, with the result that, when the buffer-stored gases are ejected from the heating gas volume, there is a sequence of relatively cool and relatively heating gas.

The switching gas introduced in the deflector channel generally has, owing to a switching arc, a high pressure and flows into the heating gas volume at an increased flow rate. Holding elements or supports located within the deflector channel reduce the flow rate of the hot switching gas only to a negligible extent since, owing to the high flow rate of the hot switching gas, sufficient flow and therefore simple deflection and guidance of the switching gas are still possible.

The deflector element can have electrically insulating or electrically conductive materials.

Furthermore, provision can advantageously be made for a support to have radially aligned struts.

Radially aligned struts can be arranged in flow-favorable fashion within the deflector channel. In this case, a sufficient cross-sectional area remains between the struts for guiding gas within the deflector channel. In this case, the struts can be designed to have a suitable shape favoring flow. It is thus possible, for example, for the struts to be formed in the contour of a ring, with the ring having individual apertures. The struts delimit the apertures. It is thus possible for provision to be made, for example, for circular cutouts to be arranged within a ring, wherein the remaining ring material forms struts which are aligned in the radial direction in order to position the deflector element. The holding forces are therefore absorbed by the deflector element in the interior of the deflector channel. In addition to the use of circular cutouts within a peripheral ring, provision can also be made for segment-like cutouts, ellipsoidal cutouts or other suitable cross-sectional shapes for through-openings located between the struts to be used.

Advantageously, provision can be made for a support for the deflector element to be provided within a central section of the deflector channel so as to give free ends which protrude on opposite sides of the deflector element.

If a central section of the deflector channel is used for supporting the deflector element, the end-side sections of the deflector element can be kept free from holding and supporting devices. It is thus possible to arrange the deflector element flexibly within heating gas volumes with a wide variety of shapes. Depending on requirements, the position and situation within the heating gas volume can be varied relatively easily since, for example, it is possible for one end of the deflector element to abut flush with further component parts. Furthermore, by virtue of the deflector element being held centrally, it is possible to vary the shape of the deflector element, wherein it is possible for the shape to be optimized in terms of flow properties when holding elements are arranged exclusively within the deflector channel.

A further advantageous configuration can provide for the nozzle channel to open out in the form of an annular channel in the heating gas volume and for a blowing direction, which points into the heating gas volume, of the nozzle channel to open out in the deflector channel.

The nozzle channel of the insulating nozzle can have various shapes. Thus, the nozzle channel can have rotationally symmetrical shapes, for example, wherein the nozzle channel can be equipped with various sections of different cross section over its length. It is thus possible, for example, to form the nozzle channel in the form of a ring in the region in which it opens out into the heating gas volume, with the result that the nozzle channel is configured in the form of an annular channel in this region. The annular channel is suitable for allowing hot switching gas which has been passed on from the contact gap to be blown into the heating gas volume. The blowing direction of the nozzle channel into the heating gas volume is in this case directed in such a way that it opens out in the deflector channel. This ensures that switching gas emerging from the nozzle channel enters the heating gas volume and advantageously is passed over into the deflector channel and passed on from there. A specific flow direction within the heating gas volume is thus predetermined. It is advantageous here if the mouth of the annular channel and a gas inlet opening of the deflector channel are spaced apart from one another, with the result that, in the event of an excess pressure, destruction of the nozzle channel or the deflector channel is prevented since excess gas can flow away out of the region between the mouth of the nozzle channel and the gas inlet opening of the deflector channel.

A further advantageous configuration can provide for a wall, which delimits the nozzle channel, to protrude at least partially into the deflector channel.

The nozzle channel of the insulating nozzle is delimited by walls. The walls are, for example, part of the insulating nozzle or further assemblies, such as, for example, an auxiliary nozzle, a switching contact piece or the like. If a wall which delimits the nozzle channel is now extended beyond the mouth of the nozzle channel into the heating gas volume, this wall can advantageously protrude into the deflector channel. This assists the passage of hot switching gases out of the nozzle channel into the deflector channel. The wall which delimits the nozzle channel can have an insulating material, at least on its surface. For example, a switching contact piece can have a sheath consisting of insulating material. The use of polytetrafluoroethylene has proven to be advantageous, for example. This polytetrafluoroethylene can be used to delimit the nozzle channel. The wall protruding into the deflector channel should delimit at least sections of the nozzle channel. It is advantageous here to use the wall which delimits the nozzle channel in the mouth region as annular channel.

Advantageously, provision can be made for the deflector element to be supported on the wall which protrudes into the deflector channel.

Supporting the deflector element on the wall which protrudes into the deflector channel provides the possibility of forming a fixed-angle connection between the deflector channel and the nozzle channel. The space in between and therefore the geometrical arrangement of the nozzle channel and the deflector element is thus fixed. The position of the deflector channel and nozzle channel with respect to one another remains approximately the same irrespective of further component parts which are possibly movable relative to one another. Secure and permanent guidance and direction of switching gas flows within the heating gas volume is thus provided.

The wall which protrudes into the deflector channel can be hollow-cylindrical, for example, and can be, for example, a contact piece, in particular an arcing contact piece, possibly surrounded by an insulating material. This arcing contact piece can, for example, pass through the deflector channel and constrict this deflector channel, for example in the form of an annular channel. Provision can be made here for the wall which protrudes into the deflector channel to be an insulating wall, for example. However, provision can also be made for the contact piece itself which protrudes into the deflector channel to provide the nozzle channel with a structure in the region of the mouth in the heating gas volume to form an annular channel. This contact piece can be, for example, in the form of a movable or immovable arcing contact piece, for example with a tubular form. It is also conceivable for a combination of a tulip-shaped or tubular arcing contact piece and an electrically insulating layer covering the lateral side to form the wall which protrudes into the deflector channel. The deflector element can be produced from a metallic material. In order to fasten it, the deflector element can be screwed on, adhesively bonded on, clamped on etc.

A further advantageous configuration can provide for the deflector element to be formed integrally with a wall which delimits the nozzle channel.

An integral configuration of the deflector element and the wall delimiting the nozzle channel allows an integral composite to be formed within the electrical switching device. This provides the possibility of positioning the deflector element together with the wall delimiting the nozzle channel on the electrical switching device during installation.

Furthermore, owing to the integral manufacture, permanent dimensional stability is provided even in the case of series production of the switching device arrangement.

Provision can advantageously be made for the wall which delimits the nozzle channel to protrude into the deflector element in such a way that an annular deflector channel is formed.

Configuring the deflector channel with an annular section provides the possibility, in particular in the case of an annular mouth of the nozzle channel in the heating gas volume, of providing good passage of switching gas emerging from the nozzle channel into the deflector channel. The switching gas flow is in this case directed in laminar fashion, with the result that an annular curtain of switching gas which is as uniform as possible is provided as it enters the heating gas volume.

A further advantageous configuration can provide for radially aligned openings to be arranged in a wall which delimits the deflector channel.

Advantageously, the wall of the deflector channel, which has radially aligned openings, should be arranged on the deflector element on the outer lateral side. This provides the possibility of hot switching gases being deflected even into the radially aligned openings once said hot switching gases have entered the deflector channel. Thus, at least some of the quenching gas flow is caused to flow away radially through the opening, in addition to flowing away axially in the direction of the deflector channel. For this purpose, provision can be made, for example, for the support located in the interior of the deflector channel to be used for dividing the switching gas into radial and axial directions.

Given suitable positioning of the openings in the outer lateral side of the deflector element, widespread splitting of the hot switching gas into the heating gas volume can thus take place. For example, provision can be made for in each case groups of openings to be arranged in an outer wall of the deflector element in such a way as to be aligned annularly and radially around the periphery. Depending on the spacing between the individual rings and possibly a variation in the shape of the openings or the position of the openings, greater or lesser mixing of hot switching gas and cool insulating gas located within the heating gas volume can take place.

A further advantageous configuration can provide for the deflector element to have an electrically insulating effect.

In particular in the case of an integral configuration of the deflector element with a wall delimiting the nozzle channel, it is advantageous to manufacture the deflector element completely from insulating material. It is thus possible, for example, to use inexpensive plastic injection molding methods in order to form the deflector element jointly with the wall which at least partially delimits the nozzle channel. However, provision can also be made for a basic body of the deflector element to consist of electrically conductive material, for example, with it being possible for electrically insulating coatings to be applied to sections of the deflector element.

A further advantageous configuration can provide for the deflector element to be shaped rotationally symmetrically with respect to an axis.

Rotationally symmetrical arrangements have dielectrically favorable shapes and make it possible for switching gas to flow along the surfaces of said arrangements with relatively little swirl. In particular when using a switching device arrangement according to the invention in the medium-voltage, high-voltage and extra high-voltage ranges, i.e. at voltages of from 10 000 volts up to several 100 000 volts, a dielectrically favorable shape for assemblies of the switching device arrangement is advantageous.

In this case, provision can advantageously be made for the deflector element to have a substantially hollow-cylindrical shape.

Hollow-cylindrical arrangements are suitable for forming a deflector channel in the interior of the hollow cylinder or for delimiting corresponding annular channels by introducing further walls into the interior of a hollow cylinder with a circular cross section. In this case, a hollow cylinder has a substantially uniform contour over its length. In this case, provision can easily be made for individual projections, edges, castings etc. to be provided on a hollow-cylindrical basic structure so as to form a support or the like.

A further advantageous configuration can provide for the deflector element to have a shape which is substantially in the form of a hollow truncated cone.

By virtue of a configuration of the deflector element in the form of a hollow truncated cone, it is possible to extend or taper the cross section of the deflector channel over its profile. This provides the possibility of positively influencing the flow in the interior of the deflector channel. In particular in the case of continuous expansion in the direction in which hot switching gases flow into the deflector channel of the deflector element, it is advantageous to provide expansion of the channel cross section of the deflector channel as the flow rate of the hot quenching gas is reduced to an increased extent, in order to continue to cause hot switching gas from being guided away as quickly as possible over the length of the deflector channel.

Advantageously, provision can furthermore be made for the deflector channel to have a discontinuous change in cross section.

Irrespective of the basic shape of the deflector element, it is advantageous to introduce projections, peripheral shoulders, constrictions or the like within the deflector channel in order to direct and guide the hot switching gas which flows in preferred directions. In this case, a discontinuous change in cross section can also be brought about, for example, by a support arranged in the interior of the deflector channel.

A further advantageous configuration can provide for the deflector channel to have a permanent gas inlet opening and a permanent gas outlet opening.

The gas inlet and gas outlet openings of the deflector channel can have different cross-sectional areas from one another. Depending on the shape and profile of the gas inlet channel, more targeted direction and control of hot switching gases within the deflector channel can thus take place. Permanently provided gas inlet and gas outlet openings make is possible for gases to always enter the deflection channel and emerge from said deflection channel irrespective of the switching state of the switching device arrangement. The flow and directing of switching gas is thus influenced by the shape of the deflector channel. It is possible to dispense with movable arrangements such as valves or the like. The gas inlet and gas outlet openings can be formed axially one behind the other, for example.

Furthermore, provision can advantageously be made for the heating gas volume to be arranged between two coaxially aligned rotationally symmetrical contact pieces.

In the event of the arrangement of the heating gas volume between two coaxially mutually aligned rotationally symmetrical contact pieces, a basic structure of the heating gas volume which corresponds to a hollow cylinder results. The contact pieces can be, for example, arcing and rated-current contact pieces of a circuit breaker which conduct the same electrical potential. Provision is made for the contact gap between contact pieces which are capable of moving relative to one another to be formed at circuit breakers. An electrically conductive current path is produced by DC contact-making and this current path is interrupted by the DC connection between the switching contact pieces being disconnected. In order to produce or interrupt the current path, the switching contact pieces are capable of moving relative to one another. In order to be able to control erosion in the event of a switch-on or switch-off operation by switching arcs produced in the process in an improved manner, switching device arrangements preferably have sets of arcing contact pieces and rated-current contact pieces. In this case, the same electrical potential is permanently applied to mutually associated arcing and rated-current contact pieces. It is provided that, in the event of a switch-on operation, first contact is made between the arcing contact pieces, with the result that switch-on arcs occurring are guided to said arcing contact pieces. At a later time, contact is then made between the rated-current contact pieces virtually without any arcs. This makes it possible to optimize the arcing contact pieces in terms of their choice of material for resistance to erosion and to optimize the rated-current contact pieces with respect to their electrical conductivity. In the event of a switch-off operation, a reverse sequence takes place. First, DC isolation of the rated-current contact pieces is performed, whereupon the arcing contact pieces open and a switch-off arc is routinely struck between said arcing contact pieces.

Such a switch-on or switch-off arc is capable, owing to its thermal energy, of expanding and heating insulating gas or hard gas located in the region of the contact gap. This heated switching gas can be used to bring about blowing of the contact gap and therefore to clear the contact gap of electrically conductive arc plasma. For this purpose, the switching gas is buffer-stored in the heating gas volume.

A further advantageous configuration can provide for the nozzle channel to open out in the heating gas volume on the end side between the contact pieces.

The nozzle channel opening out at the end side within the heating gas volume, which has a substantially hollow-cylindrical cross section, makes it possible for the lateral-side regions of the heating gas volume to have relatively any desired design. Furthermore, a channel which is aligned rotationally symmetrically with respect to the axis of the contact pieces is matched to a dielectrically favorable configuration of a switching device arrangement.

The invention will be shown schematically in a drawing below with reference to an exemplary embodiment and will be described in more detail in the text which follows.

In the drawing

DESCRIPTION OF THE INVENTION

First, the basic design of a switching device arrangement will be described with reference to FIG. 1. The fundamental design of the switching device arrangement also applies to the variant embodiments illustrated in FIG. 2.

Figure 1:
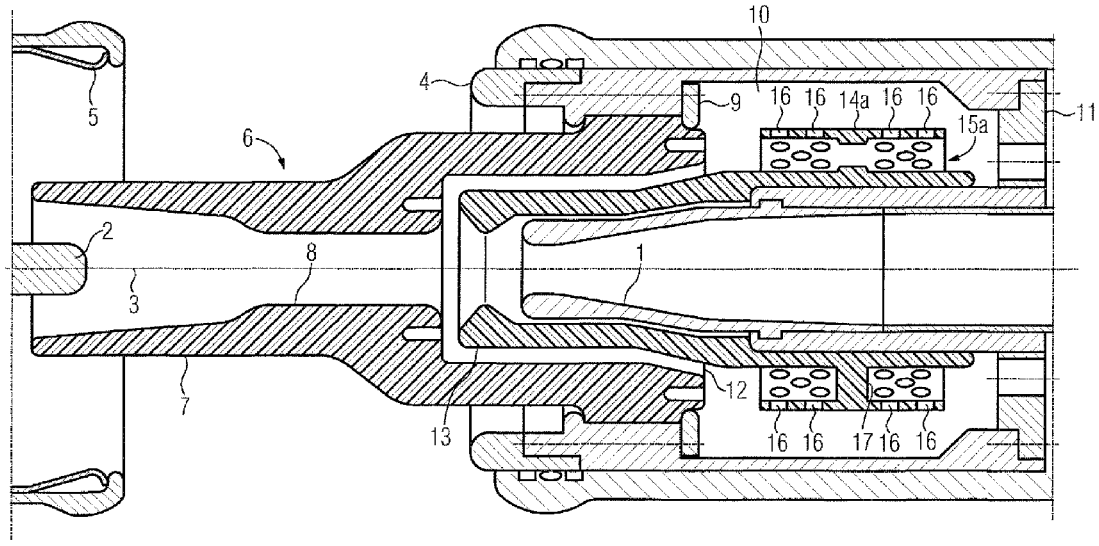
FIG. 1 shows a section through a switching device arrangement with a deflector element in a first variant embodiment.
Figure 2:
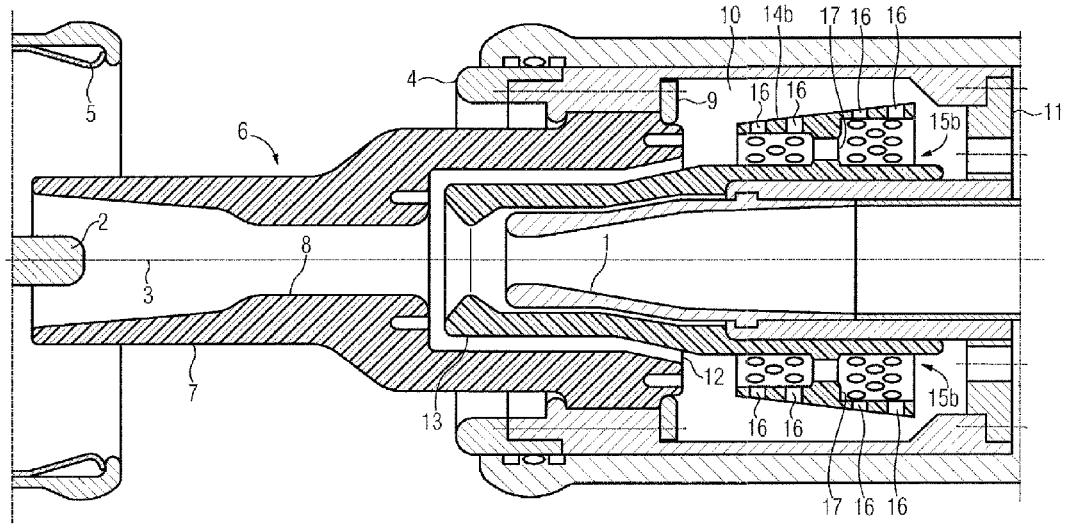
FIG. 2 shows an embodiment of a switching device with a deflector element in a second and third variant embodiment.

The switching device arrangement illustrated in FIGS. 1 and 2 has a first arcing contact piece 1 and a second arcing contact piece 2. The first arcing contact piece 1 and the second arcing contact piece 2 are arranged opposite one another so as to be aligned coaxially with respect to an axis 3. The axis 3 represents a longitudinal axis of the switching device arrangement, with the switching device arrangement being aligned substantially coaxially with respect to said longitudinal axis. The two arcing contact pieces 1, 2 are arranged spaced apart from one another and are capable of moving relative to one another along the axis 3. A first rated-current contact piece 4 is aligned coaxially with respect to the first arcing contact piece 1. A second rated-current contact piece 5 is aligned coaxially with respect to the second arcing contact piece 2. The two rated-current contact pieces 4, 5 have a tubular configuration. A contact gap 6 is formed between the mutually facing ends of the arcing contact pieces 1, 2. The two arcing contact pieces 2, 3 are capable of moving relative to one another along the axis 3 in the same way as the two rated-current contact pieces 4, 5, with the result that said arcing contact pieces can come into DC contact with one another. In this case, in the event of a switch-on operation, first DC contact is made between the two arcing contact pieces 1, 2 and then DC contact is made between the two rated-current contact pieces 4, 5. In the event of a switch-off operation, first the two rated-current contact pieces 4, 5 open, and then the two arcing contact pieces 1, 2 open. This ensures that a switching arc which occurs during a switching operation is preferably guided within the contact gap 6.

The contact gap 6 is surrounded by an insulating nozzle 7. The insulating nozzle 7 is, for example, a body which is produced using a sintering method and consists of polytetrafluoroethylene. The insulating nozzle 7 has a nozzle channel 8. The nozzle channel 8 has a plurality of sections with different cross sections. The insulating nozzle 7 is held on the first rated-current contact piece 4. For this purpose, an annularly projecting shoulder is provided on the first rated-current contact piece 4, with a bead of the insulating nozzle 7 being pressed against said shoulder. Using a screw-type connection 9, which has an annular configuration, the insulating nozzle 7 is connected to the first rated-current contact piece at a fixed angle.

A hollow-cylindrical heating gas volume 10 is formed between the first rated-current contact piece 4, which is substantially tubular, and the first arcing contact piece 1. The hollow-cylindrical heating gas volume 10 has substantially circular cross sections and is aligned coaxially with respect to the axis 3. The nozzle channel 8 opens out into the heating gas volume at one end-side end of the heating gas volume 10, said end facing the contact gap 6.

The first arcing contact piece 1 is connected to the first rated-current contact piece 4 at a fixed angle via a connecting element 11. The connecting element 11 forms a delimiting wall at that end of the heating gas volume which faces away from the contact gap 6. Cutouts are provided in the delimiting wall of the connecting element 11 and can be closed if necessary.

Both the first arcing contact piece 1 and the second arcing contact piece 2 as well as the first rated-current contact piece 4 and the second rated-current contact piece 5 can comprise a plurality of component parts. The first rated-current contact piece 4, which is associated with the first arcing contact piece 1, and the second arcing contact piece 2, which is associated with the second rated-current contact piece 5 each conduct the same electrical potential, irrespective of the switching state of the switching device. The first arcing contact piece 1 and the first rated-current contact piece 4 are electrically conductively connected to one another via the connecting element 11.

The first arcing contact piece 1 has a bush-shaped opening at its end facing the contact gap 6. The second arcing contact piece 2 has a mirror-inverted bolt-like structure, with the result that the second arcing contact piece 2 can move into a socket-shaped opening in the first arcing contact piece 1 so as to make contact. In its further profile pointing away from the contact gap 6, the first arcing contact piece 1 has a substantially tubular design. This makes it possible for the interior of the first arcing contact piece 1 to be used to pass on fluid media, for example insulating gas, switching gas etc.

The first arcing contact piece 1 protrudes partially into the nozzle channel 8 of the insulating nozzle 7, with the result that, owing to the coaxial alignment of the insulating nozzle 7 and the first arcing contact piece 1, an annular mouth 12 of the nozzle channel 8 in the heating gas volume 10 is formed. Owing to the first arcing contact piece 1, the nozzle channel 8 is shaped in the form of an annular channel in the region of overlap between the nozzle channel 8 and the first arcing contact piece 1. In addition, the first arcing contact piece 1 is surrounded by a so-called auxiliary nozzle 13. The auxiliary nozzle 13 has an electrically insulating effect. The outer lateral surface of the first arcing contact piece 1 is surrounded by the auxiliary nozzle 13. The nozzle channel 8 is delimited between the outer lateral surface of the auxiliary nozzle 13 and the nozzle channel 8, in which the auxiliary nozzle 13 protrudes correspondingly. The wall of the auxiliary nozzle 13 is extended so as to protrude beyond the annular mouth 12 of the nozzle channel 8 from the contact gap 6 and at least partially surrounds the first arcing contact piece 1 on the lateral side in the region of the heating gas volume 10 as well.

As shown in FIG. 1, a first variant embodiment of a deflector element **14*a* is arranged within the heating gas volume 10. The deflector element 14*a* has a hollow-cylindrical, rotationally symmetrical structure, which is aligned coaxially with respect to the axis 3. Both the first arcing contact piece 1 and the extended wall of the auxiliary nozzle 13 pass through the deflector element 14*a* over its entire length. As a result, a deflector channel 15*a* is formed, which is substantially hollow-cylindrical. Openings 16 are provided in the lateral-side wall of the deflector element 14*a*. The openings 16 are in each case aligned radially with respect to the axis 3 and pass through the wall which delimits the deflector channel 15*a* on the outer lateral side. In this case, the openings 16 are each arranged uniformly distributed on annularly peripheral paths, wherein a plurality of axially offset paths are arranged along the axis 3 on the deflector element 14*a*. The deflector element 14*a* has free ends in the axial direction of the axis 3, it being possible for said free ends to be subjected to corresponding shaping, if required. The free ends are spaced apart from the end-side delimiting faces of the heating gas volume 10**.

A support 17 is arranged within the deflector channel **15*a*. The support 17 is in the form of a peripheral ring, which is perforated by individual cutouts in the axial direction of the axis 3. The cutouts can in this case have different cross sections, wherein webs are formed between the cutouts in the ring, by means of which webs the deflector element 14***a* is connected to the wall which is drawn out via the annular mouth 12 of the nozzle channel 8. It is possible in this case, irrespective of the configuration of the deflector element 14*a*, for the deflector element 14*a* to be integral with the wall, which also delimits the nozzle channel 8, or for the deflector element 14*a* to rest on such a wall and, for example for a press fit, a clearance fit or the like to be provided.

In the present case, the wall which also delimits the nozzle channel 8 passes through the deflector channel 15*a* completely. In the present example shown in FIG. 1, the deflector channel 15*a* is formed between an inner lateral surface of the hollow-cylindrical deflector element 14*a* and a wall which also delimits the nozzle channel 8. In the present example, the deflector element 14*a* is integrally connected to the auxiliary nozzle 13, and therefore also integrally connected to a wall, which delimits the nozzle channel 8. In this case, provision is made for the auxiliary nozzle 13 to be formed from a plastic, preferably polytetrafluoroethylene, in addition to the deflector element 14*a*.

In the event of the occurrence of a switching arc between the two arcing contact pieces 1, 2, insulating gas located in this region is heated and expanded, with the result that hot switching gas is produced. Insulating material of the insulating nozzle 7 is also gasified, if appropriate. At least some of the switching gas which has expanded and heated passes through the nozzle channel 8, driven by the switching arc burning in the interior of the insulating nozzle 7 in the contact gap 6, via the annular mouth 12 into the heating gas volume 10. The hot switching gases flow out of the nozzle channel 8 in the discharge direction into the deflector channel 15*a* of the deflector element 14*a*. Within the deflector element 14*a*, some of the switching gas is deflected into the openings 16 in the radial direction and some of the switching gas passes completely through the deflector channel 15*a* and passes out of said deflector channel via a gas outlet opening again in the axial direction of the axis 3. Cold insulating gas located within the heating gas volume 10 is thus preferably passed through in stratified fashion, with the result that gas which is buffer-stored in the heating gas volume 10 flows out again in the direction of the contact gap 6 via the nozzle channel 8 when the switching arc in the contact gap 6 subsides. In the event of a return flow of the gas out of the heating gas volume 10, said gas preferably enters the zone between the mouth 12 of the nozzle channel 8 and the gas inlet opening of the deflector channel 15*a* into the nozzle channel 8 from radial directions.

FIG. 2 shows the basic structure of an electrical switching device comparable with that in FIG. 1, in section. Apart from the shape of the deflector element shown in FIG. 1, the configurations are functionally identical, with the result that the statements made with respect to FIG. 1 with respect to the arrangement, mode of operation, materials etc., also apply to the arrangement shown in FIG. 2. Therefore, the same reference symbols have been used for functionally identical assemblies in FIG. 2 as were used in FIG. 1.

An arrangement of a second and a third variant configuration of a deflector element 14*b* is provided with the auxiliary nozzle 13 used as shown in FIG. 2. In this case, the second variant configuration is illustrated above the axis 3 and the third variant configuration is illustrated below the axis 3. In one configuration of the deflector element 14*b*, one of the two variants can be used, with this variant correspondingly running completely around the axis 3.

The second variant of the deflector element 14*b* has a structure which is substantially in the form of a hollow truncated cone. The axis of rotation of the hollow truncated cone is aligned coaxially with respect to the axis 3. The second variant of the deflector element 14*b* rests on the wall of the auxiliary nozzle 13, which also delimits the nozzle channel 8. For this purpose, this wall is extended beyond the annular mouth 12 of the nozzle channel 8, with the result that this wall completely passes through the second variant of the deflector element 14*b*. A support 17 is provided in a central section of the deflector element 14*b*, such a support having a large number of struts, which are aligned radially about the axis 3, as a result of which the second variant of the deflector element 14*b* is supported on the auxiliary nozzle 13 against the wall which also delimits the nozzle channel 8. In turn, an integral configuration can be provided. However, provision can also be made for the second variant of the deflector element 14*b* to merely rest on the auxiliary nozzle 13. As shown in FIG. 2, a fully plastic embodiment of the deflector element of the second variant 14*b* is provided, with this embodiment being formed integrally with the auxiliary nozzle 13. In turn, radially aligned openings 16 are provided in the lateral surface, said openings passing through a wall, on the outer lateral side, of the second variant of the deflector element 14*b* in such a way as to run around the axis 3 in a plurality of rings, which are spaced axially apart from one another.

The second variant configuration of the deflector element 14*b* is illustrated above the axis 3. There, the wall is formed with an approximately constant wall thickness over the length of the deflector channel 15*a*. In the third variant configuration of the deflector element 14*b* illustrated below the axis 3, a stepped formation is provided in the region of the central section in which the struts of the support 17 are located, with the result that the wall of the second variant of the deflector element 14*b* has step-like jumps. This results in an outer lateral surface of a hollow truncated cone which has a stepped formation on the inner lateral side between two (hollow-) cylindrical sections of the deflector channel 15*a* which are positioned axially one behind the other. A first (hollow-) cylindrical section of the deflector channel 15*a* has a reduced outer diameter in comparison with a second hollow-cylindrical section of the deflector channel 15*a*. A jump from the first section to the second section is provided in the central section, in which the struts of the support 17 are also arranged. That which has been mentioned with respect to FIG. 1 also applies to the directing and guidance of a hot switching gas flow emerging from the mouth 12 of the nozzle channel 8. In this case, too, the discharge direction of the nozzle channel 8 is directed in the direction of the heating gas volume 10 in such a way that outflowing switching gas is introduced directly into the deflector channel 15*b*. In this deflector channel 15*b*, radial deflection partially occurs and partial flows of the hot switching gas emerge from the openings 16. Some of the switching gas also emerges from the gas outlet opening, which is arranged opposite the gas inlet opening of the deflector channel 15*b*, in the axial direction of the axis 3, however.

In the event of a drop in pressure in the nozzle channel 8, a return flow of the quantity of gas with elevated pressure which has been buffer-stored in the heating gas volume 10 takes place. In this case, buffer-stored gas also flows out of the radial directions into the gap region between the mouth 12 and the gas inlet opening of the deflector channel 15*b* and flows away in the direction of the contact gap 6 through the nozzle channel 8.

In addition to the variant configurations and shapes of the individual assemblies shown in FIGS. 1 and 2, it is also possible for different structural configurations to be provided. Further shapes can also be provided in particular with respect to the configuration and embodiment of the deflector elements 14*a*, 14*b* and the deflector channels 15*a*, 15*b*. The basic mode of operation of the deflector elements 14*a*, 14*b*, as illustrated in the figures, is identical.

The invention claimed is:

1. A switching device assembly with a contact gap, the assembly comprising:

an insulating nozzle at least partially surrounding the contact gap, said insulating nozzle having a nozzle channel opening out into a hot gas space;

a deflector element disposed in said hot gas space, said deflector element having a deflector channel and being supported within said deflector channel; and a support with radially aligned struts in said deflector channel.

2. The switching device assembly according to claim 1, wherein a wall delimiting said nozzle channel protrudes at least partially into said deflector channel.

3. The switching device assembly according to claim 2, wherein said deflector element is supported on said wall that protrudes into said deflector channel.

4. The switching device assembly according to claim 1, wherein said deflector element is formed integrally with a wall delimiting said nozzle channel.

5. The switching device assembly according to claim 2, wherein said wall delimiting said nozzle channel protrudes into said deflector element to form an annular deflector channel.

6. The switching device assembly according to claim 1, wherein a wall that delimits said deflector channel has radially aligned openings formed therein.

7. The switching device assembly according to claim 1, wherein said deflector element is formed to have an electrically insulating effect.

8. The switching device assembly according to claim 1, wherein said deflector element is rotationally symmetrical with respect to an axis.

9. The switching device assembly according to claim 8, wherein said deflector element has a substantially hollow-cylindrical shape.

10. The switching device assembly according to claim 8, wherein said deflector element has a shape substantially of a truncated hollow cone.

11. The switching device assembly according to claim 1, wherein said deflector channel has a discontinuous change in cross section.

12. The switching device assembly according to claim 1, wherein said deflector channel has a permanent gas inlet opening and a permanent gas outlet opening.

13. The switching device assembly according to claim 1, wherein said hot gas space is formed between two coaxially aligned, rotationally symmetrical contact pieces.

14. The switching device assembly according to claim 13, wherein said nozzle channel opens out in said hot gas space on an end side between said contact pieces.

15. A switching device assembly with a contact gap, the assembly comprising:

an insulating nozzle at least partially surrounding the contact gap, said insulating nozzle having a nozzle channel opening out into a hot gas space;

deflector element disposed in said hot gas space, said deflector element having a deflector channel and being supported within said deflector channel; and a support for said deflector element disposed within a central section of said deflector channel, with free ends projecting on opposite sides of said deflector element.

16. A switching device assembly with a contact gap, the assembly comprising:

an insulating nozzle at least partially surrounding the contact gap, said insulating nozzle having a nozzle channel opening out into a hot gas space;

a deflector element disposed in said hot gas space, said deflector element having a deflector channel and being supported within said deflector channel; and wherein said nozzle channel opens out as an annular channel in said hot gas space, and wherein a blowing direction, which points into said hot gas space, of said nozzle channel opens out in said deflector channel.

* * * * *